United States Patent [19]

Kovacs et al.

[11] 4,005,685

[45] Feb. 1, 1977

[54] FUEL INJECTION APPARATUS

[76] Inventors: Endre Kovacs; Peter Kovacs; Michael Kovacs, all of 1708 Cedar Drive; Marta Kovacs, 1707 Cedar Drive; Geza Kovacs, 1610 Cedar Drive, all of Plant City, Fla. 33566

[22] Filed: July 29, 1975

[21] Appl. No.: 600,023

[52] U.S. Cl. ..... 123/33 G; 123/32 JV; 239/533.2

[51] Int. Cl.[2] ..... F02M 47/06

[58] Field of Search ..... 123/32 JV, 33 G, 139 AH, 123/139 A; 239/533, 93–95

[56] References Cited

UNITED STATES PATENTS

| | | | |
|---|---|---|---|
| 3,255,974 | 6/1966 | Roosa | 239/533 |
| 3,425,635 | 2/1969 | Guertler | 239/533 X |
| 3,537,653 | 11/1970 | Jones | 239/533 |

*Primary Examiner*—C. J. Husar
*Assistant Examiner*—Tony M. Argenbright
*Attorney, Agent, or Firm*—A. Yates Dowell, Jr.

[57] ABSTRACT

Fuel injection apparatus for injecting gasoline or other combustible fuel into the cylinders of an internal combustion engine. The apparatus includes a fuel injector body having a diaphragm through which a needle valve extends and a constant fluid pressure is maintained on one side of the diaphragm to urge the needle valve toward closed position. A higher fluid pressure is intermittently applied to the other side of the diaphragm so that the needle valve is opened to spray fuel under pressure into the internal combustion engine, and when the higher pressure is relieved the introduction of fuel is interrupted.

5 Claims, 4 Drawing Figures

FUEL INJECTION APPARATUS

BACKGROUND OF THE INVENTION

1. Field of the Invention

This invention relates generally to the introduction of fuel into internal combustion engines and relates specifically to a fuel injector by means of which gasoline under high pressure is injected into a diesel type engine.

2. Description of the Prior Art

In the past a mixture of combustible fuel and air has been pumped from a carburetor to the individual cylinders of an internal combustion engine. However, the carburetor system has not been efficient since the cylinders nearest to the carburetor normally received a rich mixture, while the cylinders remote from the carburetor received a lean mixture so that the work performed by the various cylinders was not equal. Many efforts have been made to equalize the distribution of the fuel, including providing multi-barrel carburetors as well as providing fuel injectors by means of which a fixed quantity of combustible mixture was injected into each cylinder.

In most fuel injectors, gasoline under pressure is pumped into a fuel chamber having a diaphragm with a needle valve on one side and a compression spring on the other side to urge the needle valve to closed position. When the pressure of the combustible mixture overcame the pressure applied by the spring, the diaphragm and needle valve were opened to permit the mixture to be sprayed through a plurality of orifices into the combustion chamber. However, the axial movement of the needle valve must be guided and since gasoline has little or no lubricating qualities, the movement of the needle caused wear between the contacting surfaces so that the injector nozzle failed to function properly. Some examples of the prior art are the U.S. Pat. No. to Hesselman 1,786,844; Wiegand et al 2,430,264; Palumbo 2,470,717; Guertler 3,425,635; and Guegan et al 3,688,986.

SUMMARY OF THE INVENTION

The present invention is embodied in a fuel injection apparatus having a body with a needle valve mounted axially therein. The upper portion of the needle valve is slidably mounted in a guide sleeve located on one side of a metal diaphragm. The lower portion of the needle valve extends through the central portion of the diaphragm into a pressure chamber and terminates in a conical valve member which normally engages a valve seat. Oil under a predetermined constant pressure is introduced into the upper portion of the body where it applies a fixed pressure to one side of the diaphragm, and simultaneously lubricates the head or upper portion of the needle valve within the guide sleeve. Periodically, gasoline or other combustible fuel under a higher pressure from a fuel pump or the like is introduced into the pressure chamber on the other side of the diaphragm to cause the diaphragm to flex and raise the needle valve so that the fuel under pressure passes through the valve seat and is discharged through at least one orifice into the combination chamber of the engine. As the pressure of the fuel is reduced at the end of the power stroke of the fuel pump, the pressure of the oil above the diaphragm overcomes the pressure of the fuel within the pressure chamber and seats the needle valve member to interrupt the injection of fuel into the combustion chamber.

It is an object of the invention to provide a fuel injection apparatus having a needle valve extending through a diaphragm and the upper portion of such needle valve and diaphragm are subjected to oil under a predetermined constant pressure, while the lower portion of the needle valve is positioned within a pressure chamber which intermittently is supplied with fuel under a higher pressure and acts against the opposite side of the diaphragm to move the needle valve axially so that fuel is injected into the combustion chamber of an internal combustion engine.

DESCRIPTION OF THE PREFERRED EMBODIMENT

Figure 1:
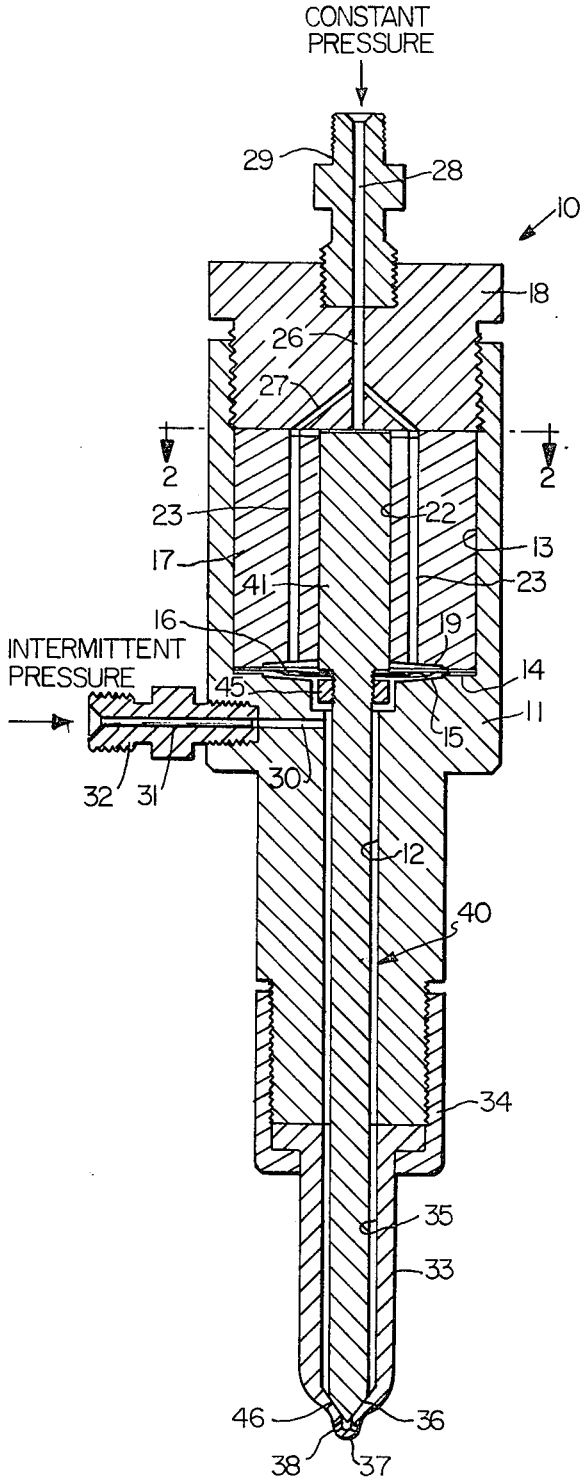
FIG. 1 is a cross-section illustrating the injection apparatus of the present invention.

With continued reference to the drawing, a fuel injector 10 is provided including a body 11 having an axial bore or pressure chamber 12 connected to a counterbore 13 by a shoulder 14. Such shoulder has a central recess 15 defining the lower portion of a diaphragm expansion cavity. A diaphragm 16 is positioned within the counterbore 13 so that the outer periphery of the diaphragm engages the shoulder 14 and is held in intimate contact therewith by a guide sleeve 17 which is mounted within the counterbore 13. A retainer 18 threadedly engages the body 11 and bears against the sleeve 17 to sleeve 17 to seal the periphery of the diaphragm against the shoulder 14.

Figure 2:
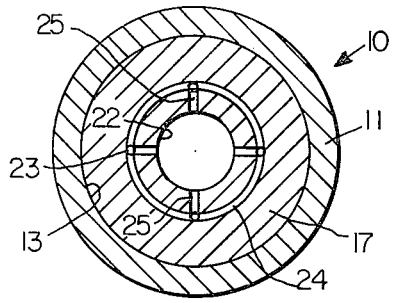
FIG. 2 is a section on the line 2—2 of FIG. 1.
Figure 3:
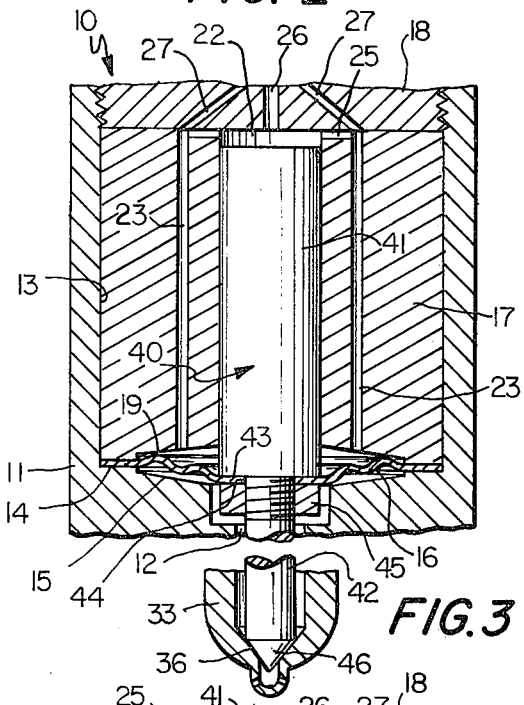
FIG. 3 is an enlarged fragmentary section illustrating the needle valve in closed position.
Figure 4:
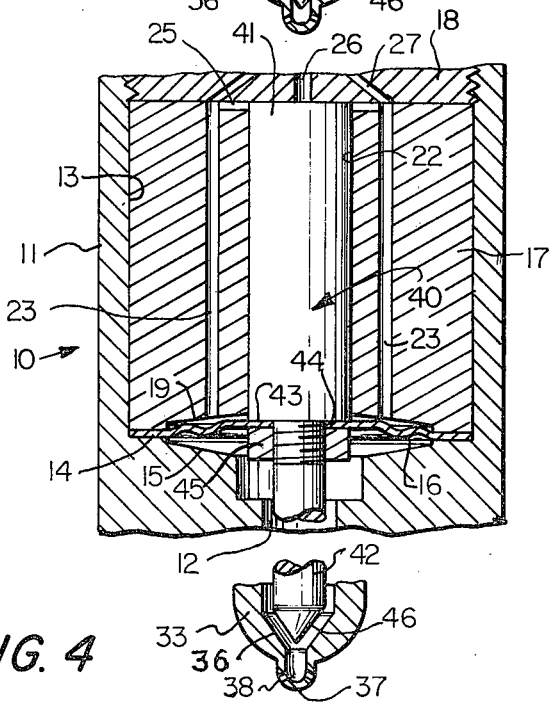
FIG. 4 is a section similar to FIG. 3 illustrating the needle valve in open position.

The lower end of the sleeve 17 is provided with a central upwardly extending recess 19 defining the upper portion of the diaphragm expansion cavity. An axially disposed guide bore 22 and a plurality of passages 23 extend from the diaphragm expansion cavity entirely through the sleeve 17 in generally parallel relationship with each other. The upper ends of the passsages 23 are connected together by a circular groove 24 (FIG. 2) and communicate with the bore 22 by means of a plurality of radial grooves 25. The retainer 18 has an axially disposed oil inlet passage 26 and one or more downwardly inclined branch passages 27 which provide communication between the oil inlet passage 26 and circular groove 24 in the upper surface of the sleeve 17. The upper end of the oil inlet passage 26 communicates with an oil inlet passage 28 of a connector 29 which is supplied with oil under a predetermined constant pressure from a source (not shown).

The lower portion of the body 11 is provided with an inlet passage 30 for a combustible fuel sich as gasoline, diesel oil, or the like and such passage communicates at one end with the bore or pressure chamber 12 of the body. The other end of the passage 30 is in alignment with a fuel inlet passage 31 of a connector 32. The connector 32 is connected to a source of fuel under pressure which is intermittently operated, such as a fuel pump (not shown). It is noted that the fuel could be a combustible mixture of gasoline and air or could be raw gasoline which is mixed with air from another source within the combustion chamber of an internal combustion engine.

At the lower end, a nozzle 33 is attached to the body 11 in any desired manner, as by a nozzle retaining nut 34; however, it is contemplated that the nozzle could be attached to the body by welding, solder, adhesives and the like, or the nozzle could be integrally formed with the body. The nozzle 33 is provided with an axial bore or pressure chamber 35 located in axial alignment with and forms an extension of the bore 12 of the body 11 and such nozzle bore terminates in a tapered frustoconical valve seat 36 which communicates with a hollow dome-shaped nipple 37 having one or more orifices 38.

An injection needle 40 having a head 41 and a stem 42 connected by a shoulder 43 is mounted for limited axial movement within the body 11. The head 41 is slidably received within the guide bore 22 of the sleeve 17 and the stem 42 extends through an opening 44 in the diaphragm 16. In order to seal the central portion of the diaphragm to the shoulder 43 of the needle 40, a nut 45 is threadedly mounted on the upper portion of the stem 42 and rotation of the nut in one direction forces the central portion of the diaphragm into sealing engagement with the shoulder 43. The lower end of the stem 42 terminates in a conical valve member 46 of a configuration which is complementary to the valve seat 36 and prevents the flow of fluid from the nozzle when in engagement.

In the operation of the device, oil or other lubricating liquid under a constant pressure is introduced through the connector 29 and the oil passage 26 and passes through the branch passages 27 and the passages 23 into the upper portion of the diaphragm cavity defined by the recess 19 and the upper surface of the diaphragm 16. The oil under pressure lubricates the guide bore 22 and simultaneously the oil within the upper portion of the diaphragm cavity urges the central portion of the diaphragm downwardly so that the valve member 46 at the lower end of the needle 40 is in intimate engagement with the valve seat 36 of the nozzle 33 so that no fluid within the bores or pressure chambers 12 and 35 can be discharged through the orifices 38.

Periodically a combustible fuel such as gasoline or the like is introduced through the inlet passages 28 and 30 into the bores 12 and 35 under the influence of a pressurizing member such as a fuel pump or the like. The pressure of the fuel being introduced is higher than the pressure of the oil in the upper portion of the diaphragm expansion cavity. When the high pressure fuel enters the bore 12, such bore is filled and the pressurized fuel enters the lower portion of the diaphragm expansion cavity defined by the recess 15 and the lower surface of the diaphragm 16 and exerts an upward force on the diaphragm 16 to move the central portion of the diaphragm and the needle 40 upwardly against the pressure of the oil in the upper portion of the expansion cavity. Upward movement of the diaphragm and the needle separates the valve member 46 from the seat 36 so that the fuel under high pressure is discharged through the orifices 38 at the bottom of the nozzle 33. As long as the pressure of the fuel within the pressure chambers 12 and 35 remains higher than the pressure of the oil in the upper portion of the expansion cavity, such as during the power stroke of a fuel pump, the valve member remains open and fuel continues to be discharged. At the end of the power stroke of the fuel pump, the pressure of the fuel within the pressure chambers 12 and 35 is reduced as the fuel is discharged until pressures on opposite sides of the diaphragm pass equilibrium and the constant pressure in the upper portion of the expansion cavity overcomes the pressure within the chambers 12 and 35 and moves the needle 40 downwardly so that the valve member 46 engages the valve seat 36 and interrupts the flow of fuel through the nozzle.

In this structure the diaphragm 16 preferably is made of metal such as stainless steel or the like and is provided with concentric undulating rings which permit ease of flexibility of the central portion of the diaphragm but which is strong enough to resist external forces without rupturing in the event that the fuel within the combustion chamber of the internal combustion engine should backfire while the valve is open.

We claim:

1. A fuel injection apparatus for injecting combustible fuel under pressure into an internal combustion engine comprising a body having an axial bore and counterbore, one end of said body having a valve seat and at least one orifice, a diaphragm positioned within said counterbore, sleeve means mounted within said counterbore in sealing engagement with the periphery of said diaphragm, said sleeve means and said body having opposed recesses defining a diaphragm expansion cavity, said sleeve means having an axial guide bore and at least one passage for fluid communicating with said cavity, means for introducing lubricating fluid under a predetermined constant pressure into said guide bore and through said passage into a portion of said cavity, and injector needle having first and second portions, said first portion being slidably received within the guide bore of said sleeve means, said second portion extending through and sealingly connected to said diaphragm, said second portion extending freely through and being in spaced relationship to the bore of said body and guided therethrough by the sliding engagement of said first portion of said injector needle and said guide bore of said sleeve means, a valve member at the end of said second portion which is remote from said first portion, said valve member normally engaging said valve seat, and means for intermittently introducing fuel under a pressure which is higher than said constant pressure into said bore of said body and into another portion of said cavity, whereby said high pressure fuel moves a portion of said diaphragm and said injection needle axially against the constant pressure to unseat said valve member from said seat and discharge high pressure fuel through said orifices.

2. The structure of claim 1 including a retainer carried by said body and engageable with said sleeve means to seal the periphery of said diaphragm.

3. The structure of claim 1 in which said sleeve means includes a plurality of interconnected passages.

4. The structure of claim 3 in which said interconnected passages communicate with said guide bore.

5. A fuel injector for intermittently injecting gasoline into an internal combustion engine comprising a body having a bore and a counterbore, said body having a valve seat and at least one orifice at one end of said bore, a diaphragm mounted within said counterbore at the other end of said bore, sleeve means with said counterbore, retainer means carried by said body in engagement with said sleeve means for causing said sleeve means to sealingly engage the periphery of said diaphragm, said sleeve means and said body having recess means defining a diaphragm expansion cavity, said sleeve means having a guide bore and passage means for fluid communicating with the upper portion of said cavity, means for introducing oil under a predetermined constant pressure into said guide bore and said cavity, an injector needle having a head and an elongated stem, said head being slidably mounted within the guide bore of said sleeve means, said elongated stem extending through said diaphragm and freely through and in spaced relationship to the bore of said body and guided therethrough by the sliding engagement of said head of said elongated stem and said guide bore of said sleeve means, a valve member located at the end of said stem remote from said head and normally engaging said valve seat, and means for intermittently introducing gasoline under a pressure which is higher than said constant pressure into the bore of said body and into said cavity to force a portion of said diaphragm and said head upwardly to move the valve member away from said valve seat, whereby gasoline under higher pressure is discharged through said orifice while the movement of the head through said guide bore is lubricated by the oil under constant pressure.

* * * * *